United States Patent [19]

Cirelli

[11] Patent Number: 4,671,748

[45] Date of Patent: Jun. 9, 1987

[54] COMPRESSOR UNIT FOR THE PRODUCTION OF COMPRESSED AIR

[75] Inventor: Franco Cirelli, Gussago, Italy

[73] Assignee: Gnutti Carlo S.p.A., Cogozzo, Italy

[21] Appl. No.: 751,819

[22] Filed: Jul. 5, 1985

[30] Foreign Application Priority Data

Jul. 5, 1984 [IT] Italy ..... 21765 A/84

[51] Int. Cl.[4] ..... F04C 29/02

[52] U.S. Cl. ..... 418/83; 418/84; 418/87

[58] Field of Search ..... 418/83, 84, 87, DIG. 1

[56] References Cited

U.S. PATENT DOCUMENTS 3,542,497 11/1970 Chapuis ..... 418/84

3,905,729 9/1975 Bauer ..... 418/87

4,342,547 8/1982 Yamada ..... 418/84

*Primary Examiner*—Carlton R. Croyle

*Assistant Examiner*—Jane E. Obee

*Attorney, Agent, or Firm*—Sughrue, Mion, Zinn, Macpeak, and Seas

[57] ABSTRACT

A compressor unit of the type in which a rotary vane compressor draws air from an intake opening and directs it to a pressure tank through a minimum-pressure valve and is self-lubricated by oil supplied by the air pressure itself includes a non-return valve in the intake opening, which maintains the compressor under pressure when it stops. Thus, the internal pressure upstream and downstream of the compressor is balanced instantaneously and the lubricating oil does not get into the compressor, avoiding the consequent danger of damage or breakage upon subsequent starting.

1 Claim, 2 Drawing Figures

COMPRESSOR UNIT FOR THE PRODUCTION OF COMPRESSED AIR

BACKGROUND OF THE INVENTION

The present invention relates to a compressor unit for the production of compressed air, of the type in which a rotary compressor draws air from an intake opening and directs it to a pressure tank through a minimum-pressure valve.

Known units of this type are presently made by a method now consolidated by the vast experience of a multitude of manufacturers all over the world. Although there are obvious differences in individual details, all the compressor units reflect a common design which will now be explained in general terms.

In known units the compressor is of the rotary volumetric type, typically with radial vanes, driven by an electric motor; these compressors draw in air from the atmosphere through an intake opening and direct it to a pressure tank through a minimum-pressure valve which opens only when a predetermined minimum pressure has been reached within the compressor unit.

It is well known that particularly accurate lubrication is of vital importance to the operation of vane compressors, not only for the bearings of the rotor but also within the casing to limit friction between the vanes and the casing itself, in order simultaneously to ensure sealing and to facilitate heat exchange which reduces the temperature and enables the efficiency of the compressor to be improved.

For this lubrication, oil supplied by the pressure of the air itself downstream of the compressor is used. To this end, a container which is partially filled with oil is provided between the compressor and the minimum-pressure valve; the pressurised air acts on the free surface of the oil so that the oil is also at the pressure of the air. The pressurised oil is then supplied to the compressor through suitable ducts and reaches the rotor bearings and the interior of the casing to ensure the necessary lubrication.

The operation of such a compressor unit under running conditions should be completely satisfactory but it is well known that other measures are necessary for starting to be possible without risk.

In fact, if the rotor were to stop suddenly and cut off the flow of air, the pressure in the container would cause oil to flow into the casing, filling the compartments between the vanes; on subsequent starting this oil, which is practically incompressible, could easily cause damage or breakage of the compressor.

In order to avoid this, the pressure in the container is reduced before the compressor is stopped. For this purpose, the container is provided with a discharge valve which is normally kept closed by a spring and the opening of which is controlled pneumatically by a pilot circuit.

In practice, the stoppage of the motor-compressor unit includes a first emptying stage and a second stage in which the rotary compressor is stopped.

In the emptying stage, the pilot circuit is connected to the pressure tank by a solenoid valve and causes:

1. the closure of the minimum-pressure valve by suitable piloting,
2. the opening of the discharge valve against the action of the spring,
3. the closing of the intake opening by means of a slide.

The pressure in the container is then lowered to atmospheric pressure and while the rotor continues to rotate creates a low pressure between it and the closed intake opening; this low pressure is used to draw the oil from the lubricating ducts of the rotor and the casing by means of a suitable transfer port in the slide which opens with the closure of the intake opening.

In this way, all the oil ducts close to the compressor are emptied and after a suitable period of time this is stopped. This stoppage is effected by a delay circuit which is activated together with the solenoid valve. When the rotor has stopped, there is no longer any pressurised oil which could fill the compartments between the vanes.

The subsequent starting can therefore take place without risk, the pressure in the pilot circuit being relieved and the rotor being started. The pressure of the air and oil in the unit increases progressively and running conditions are reached.

In addition to what has been explained, in order to allow the emptying cycle to be carried out even when the compressor unit is not connected to a pressure tank (for example during testing), the known units normally also include a so-called selector valve whereby the pilot circuit may be put into communication with the interior of the pressure container instead of with the tank. This valve is generally of an automatic or self-piloting type in accordance with a technique well known in the art.

As confirmed by its almost universal use, the design described is judged satisfactory and, as seen, effectively solves the normal problems of stoppage and starting of the machine.

In reality, these problems are solved only in the case of a desired stoppage, however, not in the case of an accidental stoppage due, for example, to unexpected power cuts. Even in this situation emptying can occur as long as the solenoid valve has a biassing spring which opens it in the absence of electrical power. In all cases, however, the stoppage of the rotor is almost simultaneous and the effectiveness of the emptying is much reduced. In particular, the pressure within the container does not reach zero before the rotor stops, which thus causes both a leakage of oil between the vanes and a sudden counter-rotation of the rotor with the consequent expulsion of a spray of an oil-air mixture through the intake opening before it has been closed completely by the slide. This phenomenon is obviously very troublesome since it fouls any filter on the intake and, in any case, the risk of damage to the vanes on subsequent starting remains.

SUMMARY OF THE INVENTION

The problem behind the present invention is that of providing a compressor unit of the type described above which can be stopped and started in any manner and at any time without any risk of damage.

This problem is solved by a compressor unit of the aforesaid type, wherein it includes a non-return valve active in the intake opening to prevent the escape of air through this opening.

The non-return valve means that all the compressor remains under pressure upon a stoppage of the rotor; thus, an internal pressure equilibrium is achieved which prevents any leakage of oil between the vanes of the compressor. Since the latter is not emptied, the situation is the same whether the compressor is stopped deliberately or is stopped accidentally.

BRIEF DESCRIPTION OF THE DRAWINGS

A preferred embodiment of a compressor unit according to the invention will now be described with reference to the appended drawings. In these drawings.

DESCRIPTION OF A PREFERRED EMBODIMENT

Figure 2:
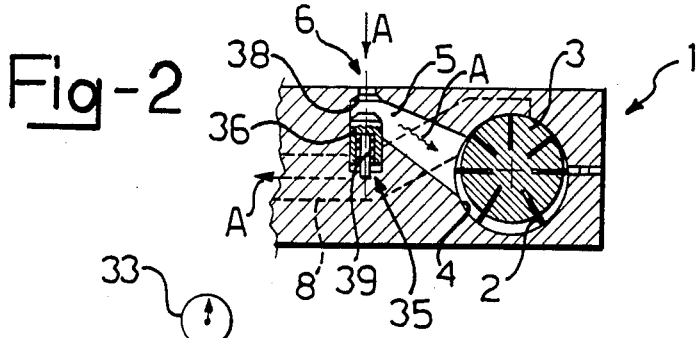
FIG. 2 is a section taken on the line II—II of FIG. 1.
Figure 1:
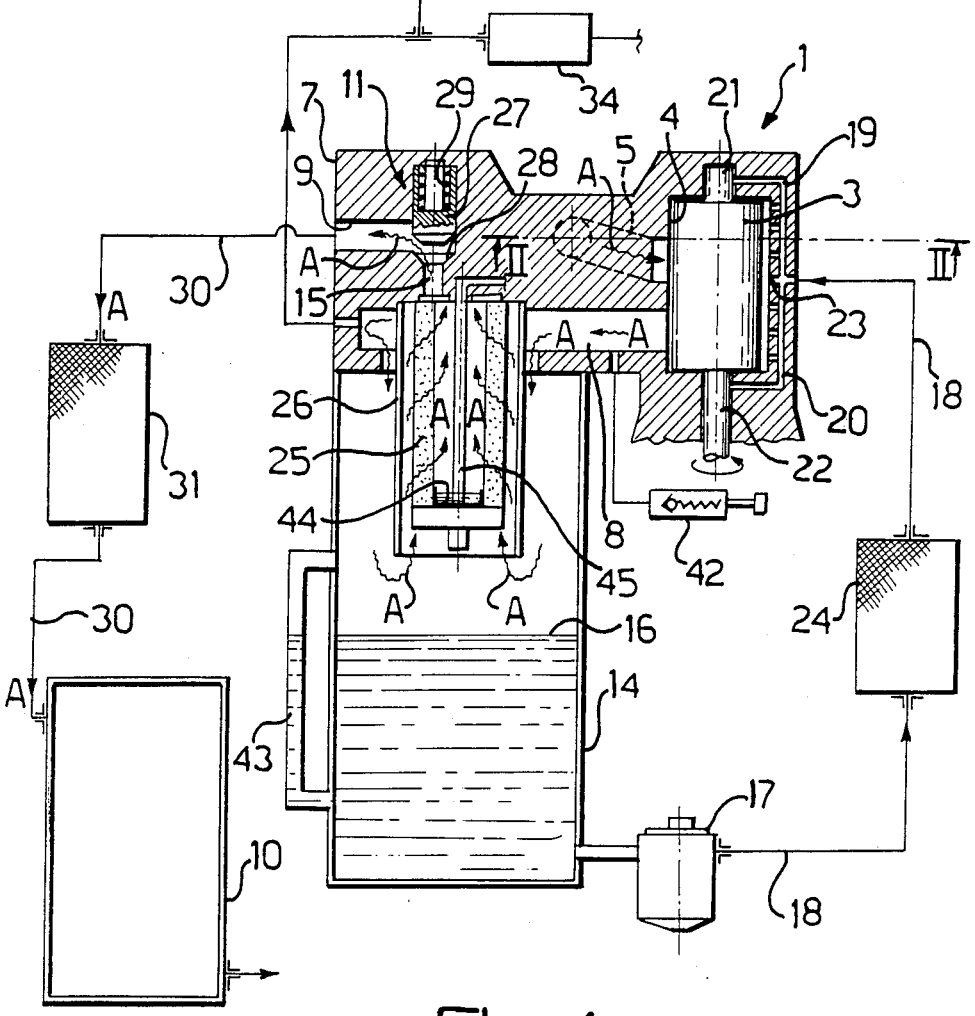
FIG. 1 is a partially-sectioned schematic view of a compressor unit according to the invention.

In the following description, the terms "upstream" and "downstream" are to be taken to relate to the main direction of movement of the air indicated by the arrows A.

A compressor unit for producing compressed air includes a rotary compressor 1, typically with vanes 2 carried by a cylindrical rotor 3 which is rotated eccentrically in a cylindrical casing 4 by an electric motor, not shown.

The cylindrical casing 4 opens upstream into an intake chamber 5 which communicates with the exterior through an intake opening 6, possibly and preferably provided with a filter grille not shown in the drawings. The casing 4 and the chamber 5 are formed in a head 7.

The casing 4 communicates downstream with a chamber 8 within the head 7, which is closed at its lower end by a large bowl or sump 14. The head 7 also includes an outlet duct 9 communicating with the chamber 8 and with a pressure tank 10 outside the compressor unit and shown schematically on a reduced scale. A minimum-pressure valve 11 is housed in the outlet duct 9. The outlet duct 9 opens into the chamber 8 through an aperture 15.

The sump 14 is partially filled to the level 16 with lubricating oil which is pressurised by the air in a lubricating circuit, schematically indicated 18. The circuit 18 includes two lubricating ducts 19 and 20 for the bearings 21 and 22 of the rotor 3, and a plurality of lubricating ducts 23 within the casing 4. To advantage, the circuit 18 also includes an oil-cooling radiator 24 and a filter 17.

Within the head 7, surrounding the aperture 15 opening into the outlet duct 9, is a cartridge filter 25 of elongate cylindrical form which extends vertically downwardly into the sump 14 to a level above the oil level 16. The filter 25 is surrounded peripherally by a dependant tubular baffle 26 fixed at its upper end to the head 7 and open to the sump 14 at its lower end.

The minimum-pressure valve 11 housed in the outlet duct 9 downstream of the aperture 15 includes a cylindrical shutter 27 guided for movement in the head 7 and biassed towards a seat 28 by a calibrated spring 29.

Downstream of the minimum-pressure valve 11, the outlet duct 9 opens into a compressed air circuit, generally indicated 30. The circuit 30 communicates with the tank 10 and has a cooling radiator 31. Also in communication with the chamber 8 are a manometer 33 and an adjustable pressostat 34 which controls the supply to the electric motor of the compressor 1, stopping it when a predetermined pressure is reached.

A non-return valve 35 is active in the intake opening 6 of the compressor 1 and allows air to enter the intake chamber 5 from the atmosphere while preventing its escape. The valve 35 is, for example, of the type in which a substantially cylindrical shutter 36 is guided for movement in the head 7 against a seat 38 in the opening 6; means, for example a spring 39, are provided for keeping the shutter 36 preferably against the seat 38.

The compressor unit is also provided with conventional accessories such as a safety valve 42 mounted on the chamber 8 and a communicating-vessels-type indicator 43 for the oil level 16. A conventional oil drainage system is also provided for collecting the oil at the bottom 44 of the cartridge filter 25. This system includes tubing which connects the cartridge filter 25 to the intake chamber 5, of this tubing only a draught tube 45 from the bottom 44 is visible.

The operation of the described compressor unit under normal running conditions is the same as that of conventional units. The non-return valve 35 remains open due to the suction action of the compressor 1 since the resilient force of the spring 39 and the mass of the shutter 36 are so small as to offer practically no resistance.

The stoppage of the compressor unit, however, differs from that of the prior art in that it is necessary simply to stop the rotor 3 of the compressor 1 by cutting off the supply to the electric motor.

In fact, when this is done, the air stops flowing through both the intake opening 6 since the non-return valve 35 is closed and through the outlet duct 9 since the minimum-pressure valve 11 is closed. The same pressure as in the chamber 8 and the sump 14 is established instantaneously in the intake chamber 5. Thus, a situation of pressure equilibrium is created between the air and the oil in all parts of the machine, and this in particular prevents any movement of oil in the ducts 23 to and from the casing 4 of the compressor 1. Clearly, since there is no emptying stage, the situation is exactly the same in the case of an accidental stoppage.

Upon subsequent starting of the compressor 1, the running conditions are re-established quickly. It is noted that the starting of the rotor 3 is facilitated by the fact that the pressures upstream and downstream are equal; in the brief transitional period, the pressure in the intake chamber 5 is lowered since the non-return valve 35 is closed.

It is noted that there is optimum lubrication of the compressor 1 even during starting, which is contrary to what occurs in conventional compressor units; in fact, while it is necessary for the lubricating circuit of the latter to be pressurised in order to optimise the lubrication, the oil remains under pressure in the compressor unit of the invention even with the machine stopped, and is immediately ready to fulfill its function as soon as the rotor starts to rotate. This fact brings about a considerable improvement in the working conditions of the oil, which thus has a much longer working life, even more than 10 times. In a similar way, the wear on the parts in relative motion (the rotor, vanes, and casing) is obviously less since they are always properly lubricated.

Finally, the extreme simplicity of the compressor unit according to the invention is to be noted. In fact, compared with prior art units, the slide assembly for closing the intake opening is replaced by an extremely simple non-return valve, while the minimum-pressure valve is now of a simpler type which does not require its closure to be piloted. Furthermore, the discharge valve and all its pilot circuits, including the solenoid valve, have entirely disappeared The selector valve which, as already stated, would allow the use of the pilot circuit even in the absence of the tank during testing of the machine is also absent. Finally, the electrical delay circuit for controlling the stoppage of the compressor is clearly no longer necessary.

I claim:

1. Compressor unit for the production of compressed air comprising:

a vaned rotary compressor;

air intake means connected to said compressor for supplying air to said compressor;

non-return valve means disposed in said intake means for completely closing said air intake means upon stoppage of said compressor;

air outlet means connected to said compressor for supplying air to a pressure tank outside said compressor unit;

minimum pressure valve means disposed in said air outlet means for completely closing said air outlet means upon stoppage of said compressor; and lubricating means for said compressor comprising a sump having a lower portion adapted to be filled with oil and an upper portion adapted to be filled with compressed air and circuit means connecting said upper portion of said sump to said air outlet means intermediate said compressor and said minimum pressure valve means for supplying compressed air to said upper portion of said sump and connecting said lower portion of said sump to said compressor for supplying oil to said compressor whereby upon stoppage of said compressor said minimum pressure valve means and said non-return valve means will completely close said air outlet passage means and said air inlet passage means, respectively to maintain the stopped compressor under balanced pressure to prevent further movement of oil into and out of said compressor.

* * * * *